US005980341A

United States Patent [19]

Mishima et al.

[11] Patent Number: 5,980,341

[45] Date of Patent: Nov. 9, 1999

[54] OUTBOARD MOTOR

[75] Inventors: Shuichi Mishima, Iwata; Toshio Watanabe; Hidetsugu Shimada, both of Hamamatsu; Katsuhiro Fukuda, Shizuoka-Ken; Jun Itoh, Hamamatsu; Satoru Takahashi, Hamamatsu; Shuichi Hagino, Hamamatsu, all of Japan

[73] Assignee: Suzuki Kabushiki Kaisha, Hamamatsu, Japan

[21] Appl. No.: 09/089,766

[22] Filed: Jun. 3, 1998

[30] Foreign Application Priority Data

Jun. 9, 1997 [JP] Japan ..... 9-151242

[51] Int. Cl.[6] ..... B63H 21/10

[52] U.S. Cl. ..... 440/88; 123/195 P; 440/900

[58] Field of Search ..... 123/195 P; 440/88, 440/89, 53, 900

[56] References Cited

U.S. PATENT DOCUMENTS

| | | | |
|---|---|---|---|
| 5,713,772 | 2/1998 | Takahashi et al. | 440/78 |
| 5,833,504 | 11/1998 | Ikeya et al. | 440/88 |
| 5,873,330 | 2/1999 | Takahashi et al. | 123/41.31 |

FOREIGN PATENT DOCUMENTS 3-172570 7/1991 Japan .

6-16187 1/1994 Japan .

*Primary Examiner*—Ed Swinehart

*Attorney, Agent, or Firm*—Finnegan, Henderson, Farabow, Garrett & Dunner, L.L.P.

[57] ABSTRACT

An outboard motor includes an engine holder, an engine disposed above the engine holder in an installed state of the outboard motor, a flywheel magnet device disposed above the engine, an oil filter disposed on a side portion of the engine, an electric equipment box, an air suction device, an exhaust device and a fuel supply device, these electric equipment box, suction device, exhaust device and fuel supply device being arranged around the engine, and an engine cover covering the engine. The air suction device is composed of a throttle body, a surge tank and an intake manifold including a plurality of branch members extending from the surge tank, the intake manifold is disposed vertically, in the installed state, on one side of the engine so that the intake manifold is located between the flywheel magnet device and the oil filter as viewed from a side portion thereof and the intake manifold has at least a portion superposed on the flywheel magnet device and the oil filter as viewed in a plan view. The electric equipment box and the exhaust device are disposed on another side of the engine opposing to the side on which the intake manifold is disposed.

6 Claims, 6 Drawing Sheets

OUTBOARD MOTOR

BACKGROUND OF THE INVENTION

The present invention relates to an outboard motor particularly having an improved air suction device such as aspirator therefor.

There is known an outboard motor including a multi-cylinder engine in which carburetors are continuously arranged in a vertical direction, as disclosed in Japanese Patent Laid-open Publication No. HEI 3-172570, for example.

Further, there is also known an outboard motor in which a fuel injector is disposed at a downstream portion of each manifold extending from a single throttle body, as disclosed in Japanese Patent Laid-open Publication No. HEI 6-16187, for example.

However, in the case of the suction device or intake device in which the carburetors are continuously arranged in a vertical direction, the structure becomes complicated, and positional layouts of the highest carburetor and the lowest carburetor are limited by a rotational surface of a flywheel and a lower cover section of an engine cover, respectively. As a result, the suction device is disposed so as to project outward from an engine, which prevents the engine from being reduced in size.

In the case of the suction device including the fuel injector, the idle revolution number of the engine is adjusted using a bypass air screw mounted to the throttle body. However, if the engine is to be reduced in size, the throttle body comes inside the engine and is surrounded by other parts, which makes it difficult to operate the bypass air screw is difficult.

SUMMARY OF THE INVENTION

An object of the present invention is to substantially eliminate defects or drawbacks encountered in the prior art mentioned above and to provide an outboard motor having an improved simple suction structure and equipped with an engine reduced in size.

Another object of the present invention is to provide an outboard motor capable of achieving an improved engine operation adjusting performance.

These and other objects can be achieved according to the present invention by providing an outboard motor comprising:

an engine holder;

an engine disposed above the engine holder in an installed state of the outboard motor;

a flywheel magnet device disposed above the engine;

an oil filter disposed on a side portion of the engine;

an electric equipment box, an air suction device, an exhaust device and a fuel supply device, which are arranged around the engine; and an engine cover covering the engine, wherein the air suction device comprises a throttle body, a surge tank and an intake manifold including a plurality of branch members extending from the surge tank, the intake manifold is disposed vertically, in the installed state, on one side of the engine so that the intake manifold is located between the flywheel magnet device and the oil filter as viewed from a side portion thereof and the intake manifold has at least a portion superposed on the flywheel magnet device and the oil filter as viewed in a plan view, and the electric equipment box and the exhaust device are disposed on another side of the engine opposing to the side on which the intake manifold is disposed.

In a preferred embodiment, the branch members have downstream ends which are connected together so as to form a flanged portion and the fuel supply device includes a delivery pipe, the flanged portion and the delivery pipe being formed integrally.

There may further comprise a starter motor disposed to a front portion of the engine adjacent to the flywheel magnet device. The throttle body is disposed in an obliquely front portion of the engine, and the surge tank is juxtaposed with the throttle body at a downstream side thereof, the throttle body being disposed in a space surrounded by the surge tank, the starter motor and the engine cover.

There may further comprise a bypass air screw, for adjusting an idling revolution number of the engine, disposed on a front surface of the surge tank so as to incline toward a forward and upward direction and also comprise an insulator interposed between the flanged portion of the branches and the engine. The fuel supply device includes a fuel injector attached to the delivery pipe and having a structure of a side feed type in which a fuel is supplied from a side portion.

According to the arrangement mentioned above, the structure of the engine can be made compact. The integral structure of the flanged portion of the downstream side end portions of the branches and the delivery pipe of the fuel supply device can also make simple and compact the entire structure of the outboard motor and improve the assembling performance.

Furthermore, the arrangement of the throttle body in the space surrounded by the surge tank, the starter motor and the engine cover makes further compact the engine structure. The arrangement of the insulator and side feed type fuel injector makes reduce the heat transfer from the engine to the flanged portion, thus being convenient.

The nature and further characteristic features of the present invention will be made more clear from the following descriptions made with reference to the accompanying drawings.

DESCRIPTION OF THE PREFERRED EMBODIMENT

A preferred embodiment of the present invention will be described hereunder with reference to the accompanying drawings.

Figure 1:
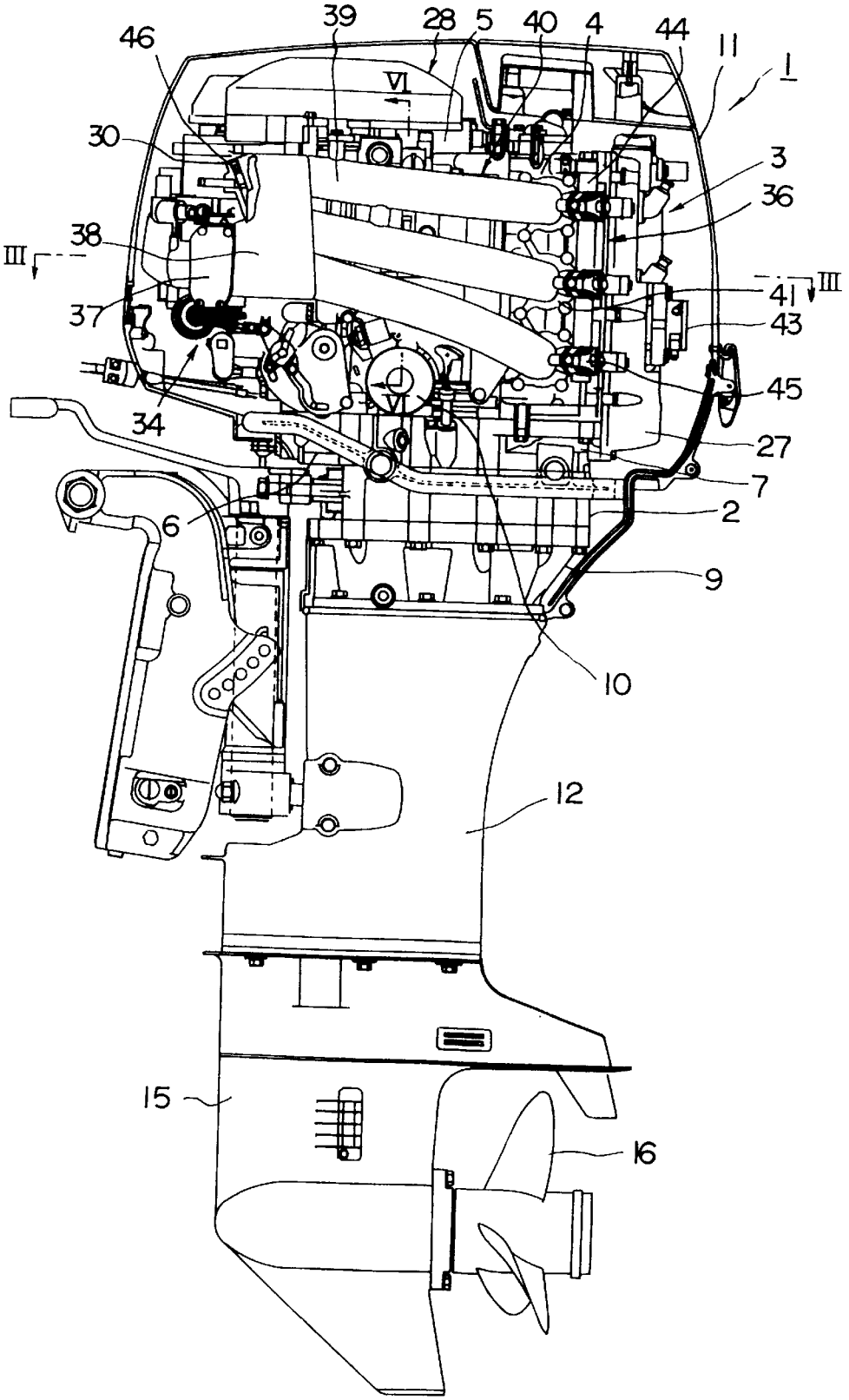
FIG. 1 is a left side view of an outboard motor according to an embodiment of the present invention.
Figure 2:
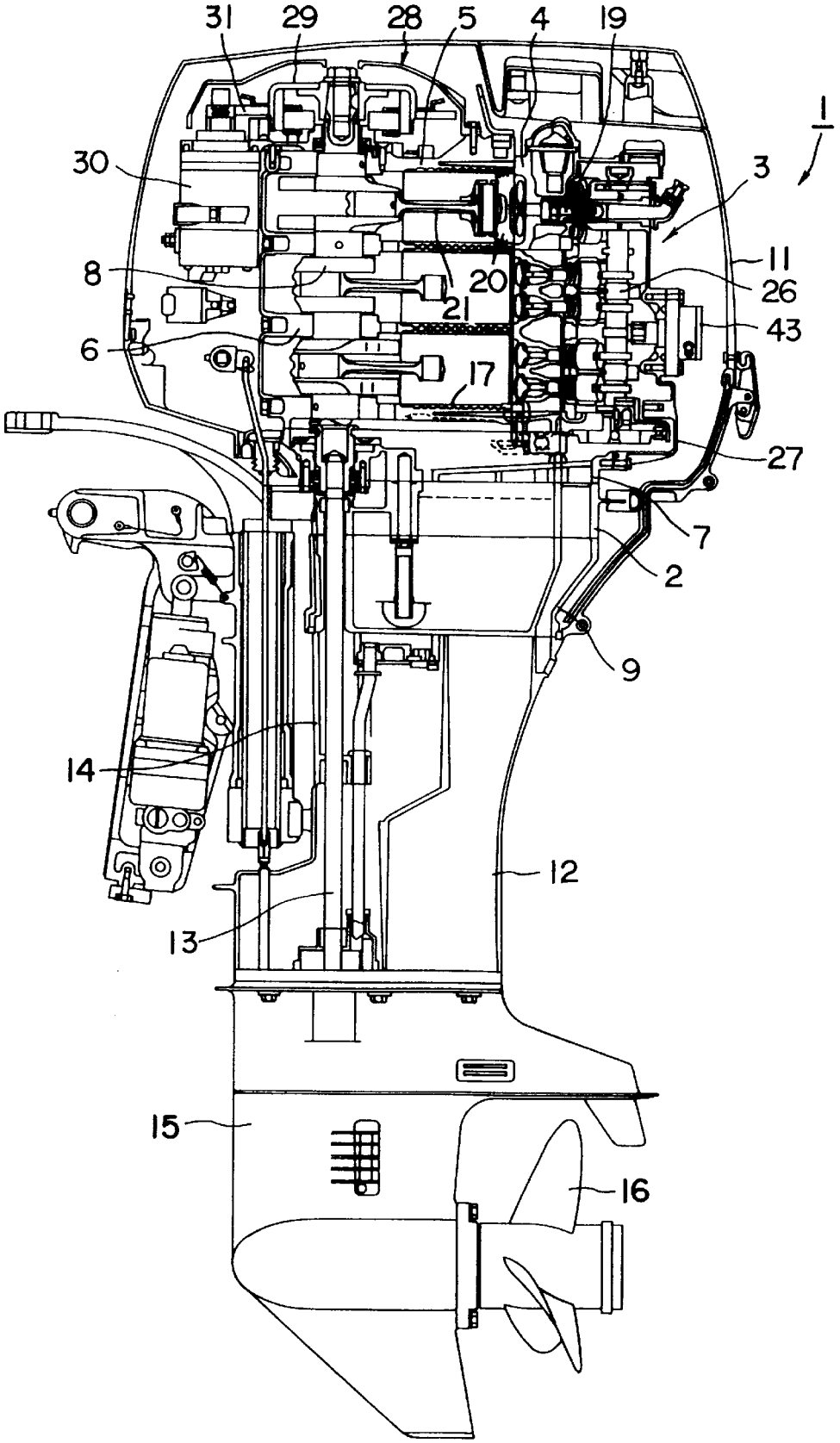
FIG. 2 is a left side longitudinal sectional view of the outboard motor shown in FIG. 1.

Referring to FIGS. 1 and 2, the outboard motor 1 includes an engine holder 2 and an engine 3 which is disposed above the engine holder 2. The engine 3 is a water cooled fourstroke-cycle three-cylinder engine and comprises a cylinder head 4, a cylinder block 5, a crankcase 6 and the like. The engine 3 is placed on the engine holder 2 through a cam chain case 7.

The cylinder block 5 is disposed on a rear side of the crankcase 6 (in FIGS. 1 and 2, on the right side of the crankcase 6). The cylinder head 4 is also disposed on a rear side of the cylinder block 5. The cam chain case 7 is disposed below the crankcase 6, the cylinder block 5 and the cylinder head 4.

A crankshaft 8 is vertically disposed in the crankcase 6, and an oil pan 9 is disposed below the engine holder 2. The engine 3 is provided at its left lowest portion with an oil filter 10. An engine cover 11 covers peripheries around the engine 3 and the oil pan 9.

A drive shaft housing 12, in which a drive shaft 13 is mounted, is disposed below the oil pan 9. An upper portion of the drive shaft 13 is fitted, e.g., through spline, to a lower end of the crankshaft 8. The drive shaft 13 extends downward in a shaft pipe 14 formed in the drive shaft housing 12, thereby driving a propeller 16 through a bevel gear and propeller shaft (both not shown) in a gear case 15 provided below the drive shaft housing 12.

Figure 3:
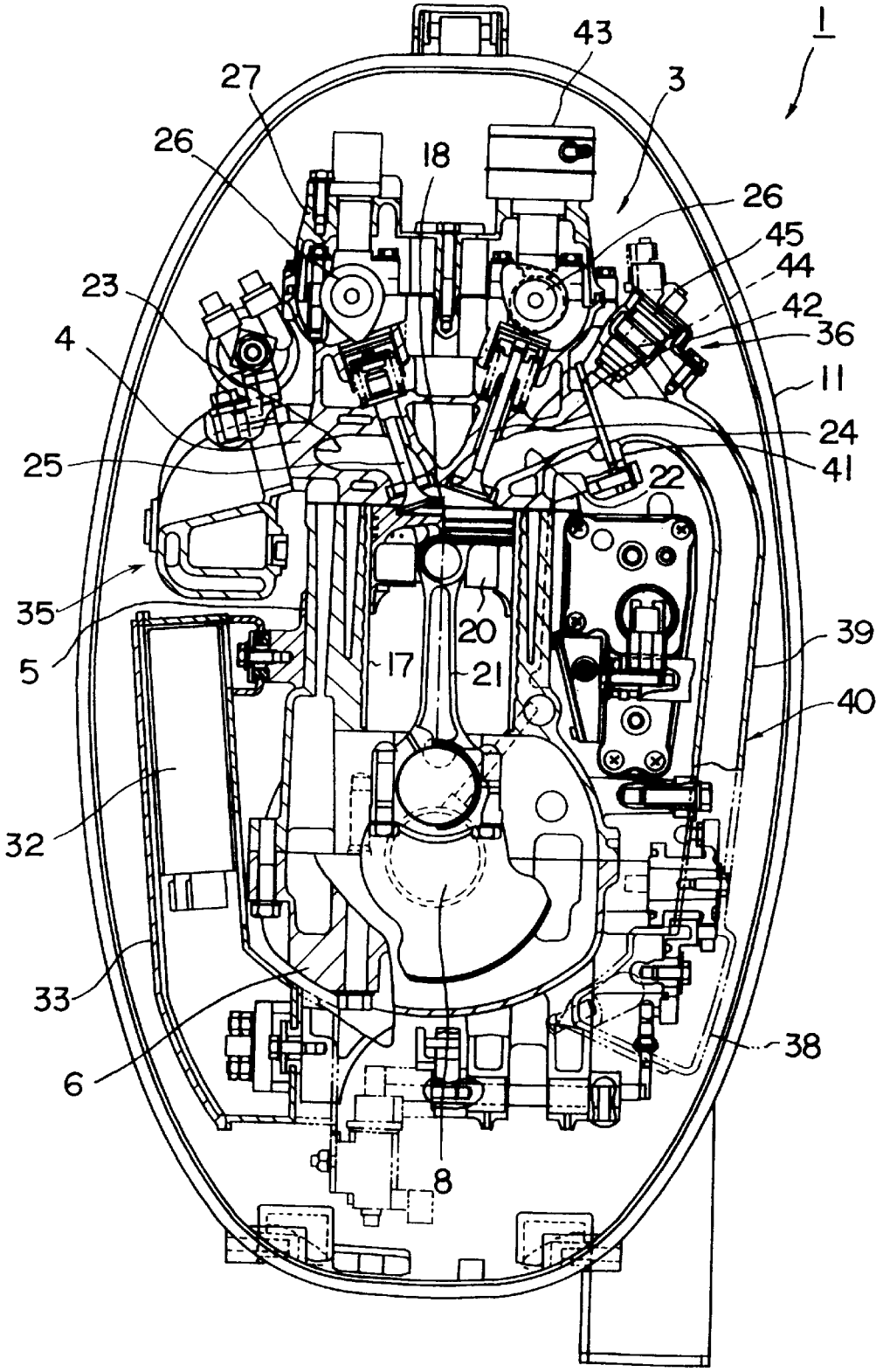
FIG. 3 is a sectional view taken along the line III—III in FIG. 1.

FIG. 3 is a sectional view taken along the line III—III in FIG. 1. As shown in FIGS. 2 and 3, a combustion chamber 18 which is aligned with a cylinder 17 horizontally formed in the cylinder block 5 is formed in the cylinder head 4 of the engine 3. A spark plug 19 is coupled from outside of the combustion chamber 18. A piston 20 is inserted into the cylinder 17 for sliding movement in a horizontal direction, and the piston 20 and the crankshaft 8 are connected to each other through a connecting rod 21. A reciprocal stroke of the piston 20 is converted into rotational movement of the crankshaft 8.

An intake port 22 and an exhaust port 23 both leading to the combustion chamber 18 are formed in the cylinder head 4. An intake valve 24 and an exhaust valve 25 are also disposed in the cylinder head 4 for opening and closing the ports 22 and 23, respectively. A camshaft 26 is also disposed on a rear portion of the cylinder head 4 for opening and closing the valves 24 and 25. The camshaft 26 and the crankshaft 8 are operatively connected to each other through the cam chain. Further, a rear portion of the cylinder head 4 is covered by the cylinder head cover 27.

Figure 4:
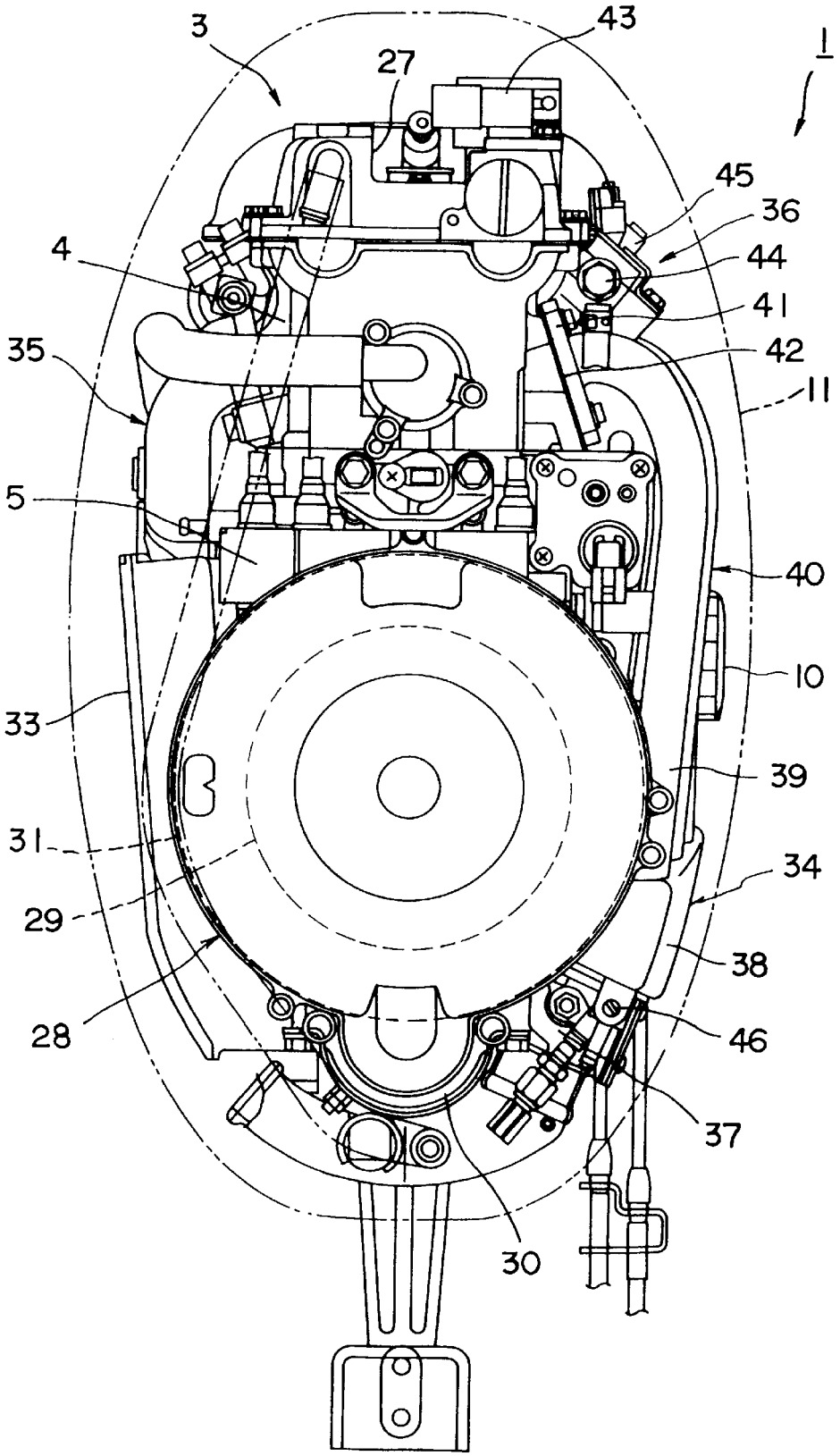
FIG. 4 is a plan view of the outboard motor shown in FIG. 1.
Figure 5:
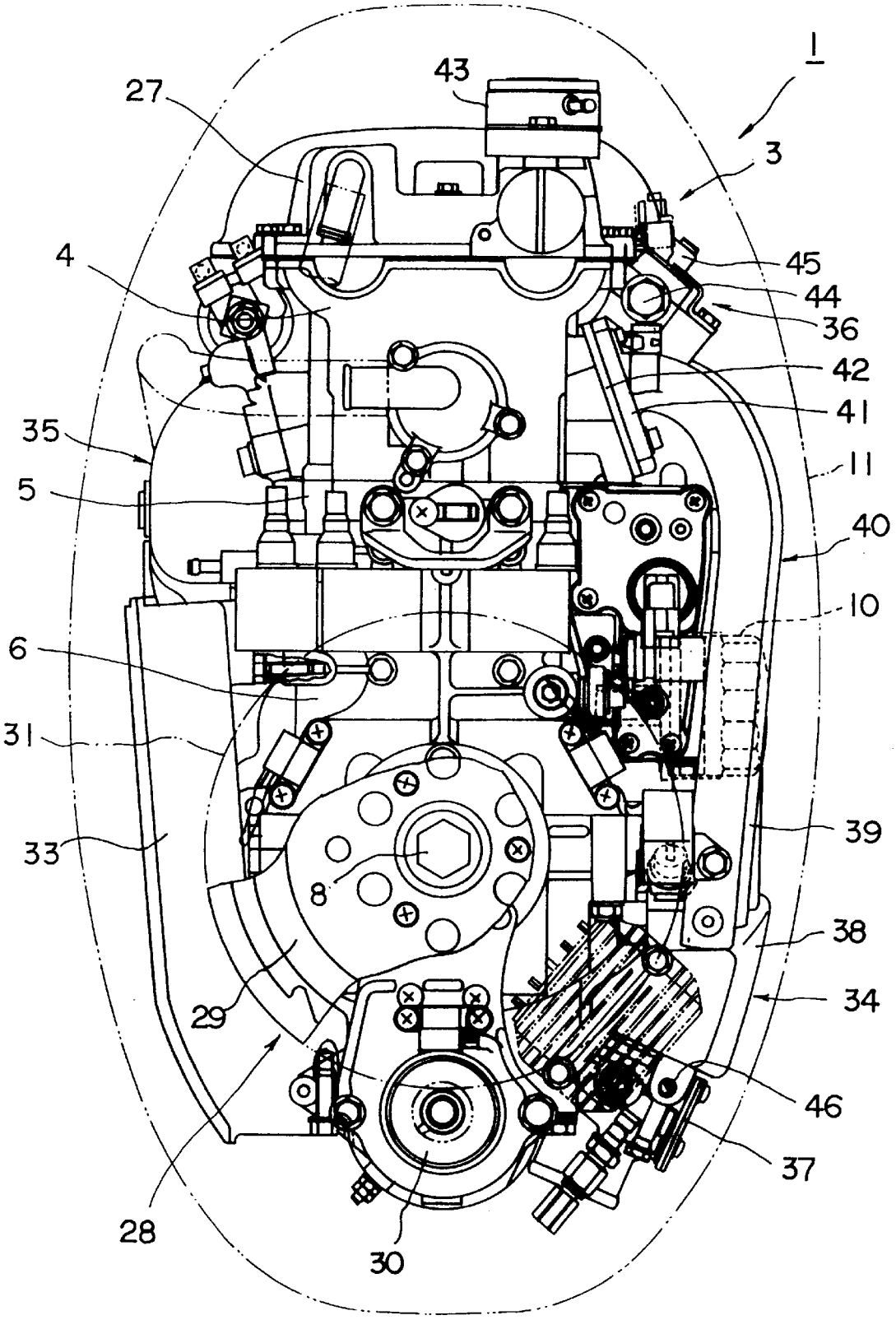
FIG. 5 is a plan view corresponding to FIG. 4 from which some elements are removed.

FIG. 4 is a plan view of the outboard motor 1 shown in FIG. 1, and FIG. 5 is a plan view corresponding to FIG. 4 from which some elements are removed.

As shown in FIGS. 1 to 4, a flywheel magnet device 28 for generating electricity is mounted on an upper end of the crankshaft 8. The flywheel 29 is formed at its outer periphery with a ring gear 31 which is operatively connected to a starter motor 30 disposed at a front portion of the engine 3.

Around the engine 3, there are arranged an electrical equipment box 33 accommodating an electrical equipment 32, an air suction device such as aspirator 34, an exhaust device 35, a fuel supply device 36 and the like. The suction device 34 mainly comprises a throttle body 37, a surge tank 38, and an intake manifold 40 including a plurality of branches 39 extending from the surge tank 38 to each of the cylinders and having the same length. The suction device 34 is disposed on one side of the engine 3. The electrical equipment box 33 and the exhaust device 35 are disposed on the other side of the engine 3 with respect to the suction device 34.

The throttle body 37 is disposed, e.g., in diagonally front of the crank case 6 of the engine 3. The surge tank 38 is juxtaposed with the throttle body 37 at downstream thereof. The throttle body 37 is disposed in a space surrounded by the surge tank 38, the starter motor 30 and the engine cover 11 as viewed in a plan view.

Figure 6:
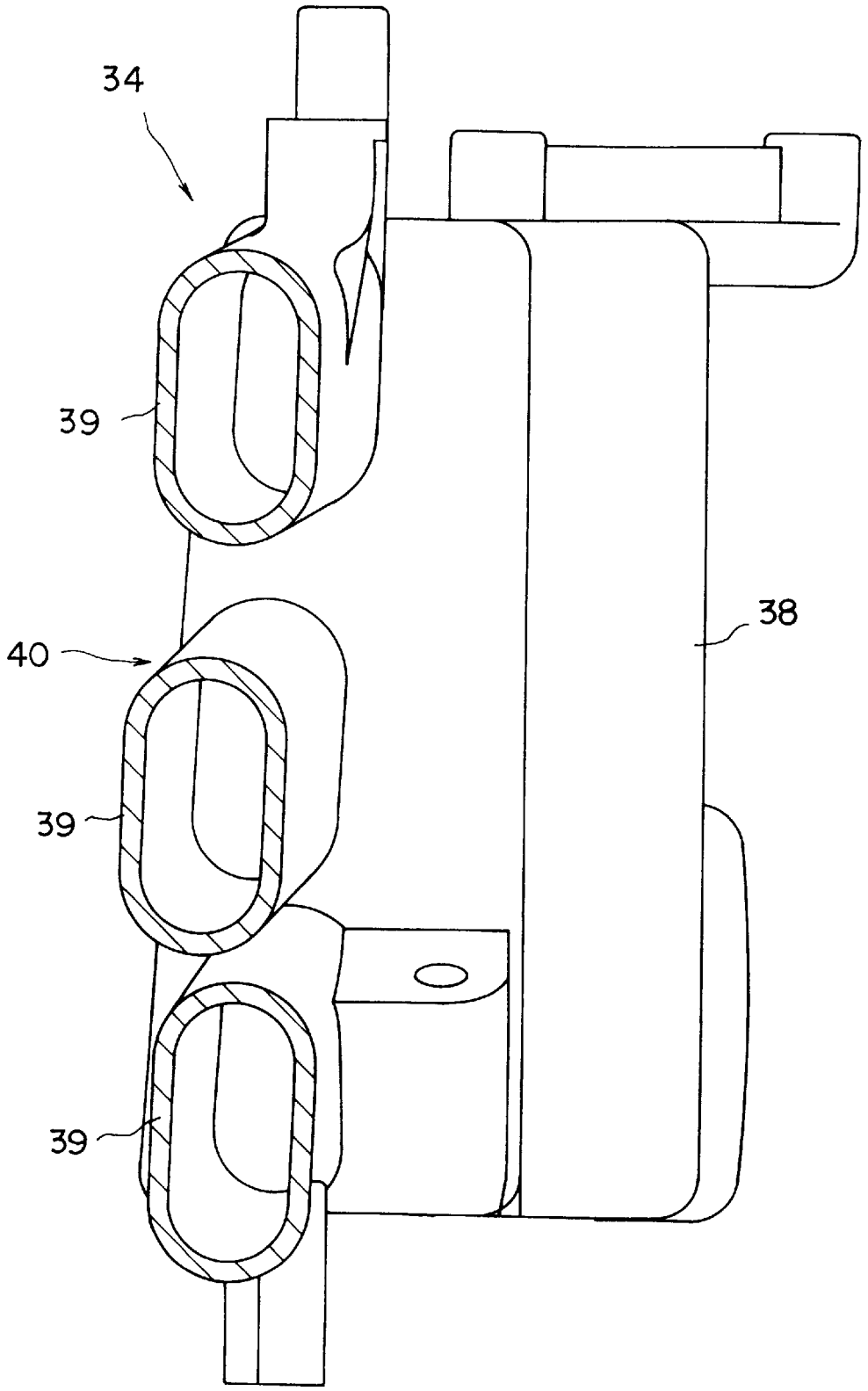
FIG. 6 is a sectional view taken along the line VI—VI in FIG. 1.

The branches 39 shown in FIG. 6, each having a vertically longer cross section, are vertically disposed on a side of the cylinder block 5 so as to be located between the flywheel magnet device 28 and the oil filter 10 as viewed from the side portion, and each of the branches 39 has at least a portion superposed on the flywheel magnet device 28 and the oil filter 10 as viewed from the top portion. The branches 39 are connected to the intake ports 22 of the cylinder head 4. At that time, downstream ends of the branches 39 are connected together to form a flange 41, and an insulator 42 is interposed between the flange 41 and the cylinder head 4.

The fuel supply device 36 includes fueling parts such as a filter and a pump. More specifically, the fuel supply device 36 comprises a connector, a fuel filter (both not shown), a fuel pump 43 disposed on the cylinder head cover 27 and driven by the camshaft 26, a vapor separator, a pressure regulator (both not shown), a delivery pipe 44, a fuel injector 45 and the like. These parts are connected by fuel hoses which are not shown.

The delivery pipe 44 is formed integrally with the flange 41 of each of the branches 39, and the fuel injector 45 is mounted to the delivery pipe 44. The fuel injector 45 is of a side feed type which supplies a fuel from the side.

As shown in FIGS. 1 and 4, a bypass air screw 46 for adjusting the idling revolution number of the engine 3 is disposed on a front surface of the surge tank 38 so as to incline toward a forward and upward direction.

The operation of the embodiment of the structure mentioned above will be described hereunder.

The branches 39 constituting the intake manifold 40 are vertically disposed on a side of the cylinder block 5 in a manner such that the branches 39 are located between the flywheel magnet device 28 and the oil filter 10 as viewed from the side portion, and at least a portion of each of the branches 39 is superposed on the flywheel magnet device 28 and the oil filter 10 as viewed from the top portion. The electric equipment box 33 and the exhaust device 35 are disposed on the other side of the cylinder block 5 with respect to the intake manifold 40. Therefore, the engine 3 can be reduced in size.

Further, the downstream ends of the branches 39 of the intake manifold 40 are connected together to form the flange 41 in a manner integral with the delivery pipe. Therefore, the structure can be made simple and the assembling performance can be improved.

Furthermore, since the throttle body 37 is disposed in a space surrounded by the surge tank 38 and the starter motor 30 and the engine cover 11 as viewed in a plan view, the engine 3 can be reduced in size.

Furthermore, since the bypass air screw 46 for adjusting the idling revolution number of the engine 3 is disposed on the front surface of the surge tank 38 so as to incline toward a forward and upward direction, the adjusting performance of the suction air is facilitated.

Further, since the insulator 42 is interposed between the cylinder head 4 and the flange 41 of the downstream end of the branch 39, a heat transfer from the cylinder head 4 to the flange 41, which makes it possible to use the side feed type fuel injector 45.

Furthermore, if the fuel injector 45 has a structure of the side feed type which supply a fuel from the side, the delivery pipe 44 can be disposed closer to the engine 3 up to a position to superposed with the fuel injector 45 and the engine 3 can be reduced in size.

It is to be noted that the present invention is not limited to the described embodiment and many other changes and modifications may be made without departing from the scopes of the appended claims.

What is claimed is:

1. An outboard motor comprising:

an engine holder;

an engine disposed above the engine holder in an installed state of the outboard motor;

a flywheel magnet device disposed above the engine;

an oil filter disposed on a side portion of the engine;

an electric equipment box, an air suction device, an exhaust device, a fuel supply device, which are arranged around the engine; and an engine cover covering the engine, wherein said air suction device comprises a throttle means, a surge tank and an intake manifold including a plurality of branch members extending from the surge tank, said intake manifold is disposed vertically, in the installed state, on one side of the engine so that the intake manifold is located between the flywheel magnet device and the oil filter as viewed from a side portion thereof and the intake manifold has at least a portion superposed on the flywheel magnet device and said oil filter as viewed in a plan view, and said electric equipment box and said exhaust device are disposed on another side of the engine opposing to the side on which the intake manifold is disposed.

2. An outboard motor according to claim 1, wherein said branch members have downstream ends which are connected together so as to form a flanged portion and said fuel supply device includes a delivery pipe, said flanged portion and said delivery pipe being formed integrally.

3. An outboard motor according to claim 2, further comprising a starter motor disposed to a front portion of the engine adjacent to the flywheel magnet device.

4. An outboard motor according to claim 3, wherein said throttle means is disposed in obliquely front portion of said engine and said surge tank is juxtaposed with the throttle means at a downstream side thereof, said throttle means being disposed in a space surrounded by the surge tank, the starter motor and the engine cover.

5. An outboard motor according to claim 4, further comprising a bypass air screw, for adjusting an idling revolution number of the engine, disposed on a front surface of the surge tank so as to incline toward a forward and upward direction.

6. An outboard motor according to claim 5, further comprising an insulator interposed between said flanged portion of the branch members and the engine and said fuel supply device includes a fuel injector attached to the delivery pipe and having a structure of a side feed type in which a fuel is supplied from a side portion.

* * * * *